US005351063A

United States Patent [19]

Kim et al.

[11] Patent Number: 5,351,063

[45] Date of Patent: Sep. 27, 1994

[54] ULTRA-WIDEBAND HIGH POWER PHOTON TRIGGERED FREQUENCY INDEPENDENT RADIATOR WITH EQUIANGULAR SPIRAL ANTENNA

[75] Inventors: Anderson H. Kim, Toms River; Leo D. DiDomenico, Spotswood; Maurice Weiner, Ocean, all of N.J.; Louis J. Jasper, Jr., Fulton, Md.; Robert J. Youmans, Brick, N.J.

[73] Assignee: The United States of America as represented by the Secretary of the Army, Washington, D.C.

[21] Appl. No.: 64,525

[22] Filed: May 19, 1993

[51] Int. Cl.[5] ..... H01Q 1/36

[52] U.S. Cl. ..... 343/895; 343/701

[58] Field of Search ..... 343/895, 701, 700 MS File, 343/793, 796; 357/30; H01Q 1/36, 1/26

[56] References Cited

U.S. PATENT DOCUMENTS

| | | | |
|---|---|---|---|
| 4,319,248 | 3/1982 | Flam | 343/895 |
| 4,329,686 | 5/1982 | Mourou | 324/95 |
| 5,028,971 | 7/1991 | Kim et al. | 357/30 |
| 5,227,621 | 7/1993 | Kim et al. | 250/214.1 |

*Primary Examiner*—Donald Hajec
*Assistant Examiner*—Hoanganh Le
*Attorney, Agent, or Firm*—Michael Zelenka; James A. DiGiorgio

[57] ABSTRACT

A photoconductive switch coupled to an energy storage device wherein the switch is comprised of photoconductive semiconductor material while the energy storage device comprises two spiral metalized arms that make up a spiral antenna. The photoconductive switch is electrically connected to the storage device to facilitate fast discharge of the stored energy through a load. A variation comprises a storage device comprising two separate pieces of substrate material each having a spiral metalized arm. The separate pieces being connected by highly dielectric material to form a spiral antenna ultra wideband radiator.

6 Claims, 2 Drawing Sheets

ULTRA-WIDEBAND HIGH POWER PHOTON TRIGGERED FREQUENCY INDEPENDENT RADIATOR WITH EQUIANGULAR SPIRAL ANTENNA

GOVERNMENT INTEREST

The invention described herein may be manufactured, used, and licensed by or for the Government of the United States of America for governmental services without the payment to us of any royalty thereon.

FIELD OF THE INVENTION

This invention relates generally to electrical pulse signal generators and more particularly to a nanosecond, kilovolt pulse generator for use in impulse radar apparatus, active electromagnetic signal jammers, and relatively high power microwave radiating systems.

BACKGROUND OF THE INVENTION

In recent years there has been active research in the area of nanosecond-type pulse generation. Such research has produced devices that utilize a high power photoconductive solid state switch coupled to an energy storage device. In order for such a device to produce a nanosecond-type pulse, the photoconductive switch must have the ability to transition from a high resistivity state to a conductive state in a sub-nanosecond time interval. One such switch, disclosed in U.S. Pat. No. 5,028,971, issued to Anderson H. Kim et al on Jul. 2, 1991, entitled, "High Power Photoconductor Bulk GaAs Switch" is incorporated herein by reference.

This GaAs switch is comprised of two mutually opposite gridded electrodes separated by a GaAs substrate capable of electrical energy storage. The stored energy can be photoconductively discharged when it receives laser light. More specifically, when the laser light is applied to the switch electron hole pairs are generated in the substrate, thus causing the electrical resistance of the semiconductor material to instantaneously decrease. This resistance change causes the stored energy to instantaneously discharge current through an output circuit. Such instantaneous discharge of current causes an RF pulse to radiate in a direction perpendicular to the substrate.

It is widely recognized that the bandwidth of such RF radiators increases as width of the radiated RF pulse narrows. It is also widely known that the faster the rise-time of the radiated pulse, the wider the radiated bandwidth. Consequently, it has become very desirable for those skilled in the art to construct devices capable of generating faster rise-time pulses.

The critical element in generating this fast rise time, high voltage pulse is the energy storage device. Heretofore, there are two general techniques used to generate faster rise-time, high power pulses. The first technique utilizes the recombination property of the semiconductor material from which the switch itself is fabricated. Pulses generated with this technique, however, typically have a relatively long recovery time at high bias voltages. This long recovery time has been attributed to the substantially long recombination time and the switch lock-on phenomena exhibited by gallium arsenide. A device having such characteristics is not desirable for the many applications requiring high power radiated pulses.

The second technique utilizes an energy storage element which is comprised of either a short section of transmission line or a capacitor. The energy storage element is photoconductively triggered to instantaneously discharge all or substantially most of its stored energy to an impedance load. As with the aforementioned technique, the extended recovery time inherent in photoconductive switches prevents this device from producing extended wideband radiation.

A major breakthrough in this pulsewidth problem, however, was solved in U.S. Pat. No. 5,227,621, issued to Kim et al Jul. 13, 1993, entitled "Ultra-Wideband High Power Photon Triggered Frequency Independent Radiator," and incorporated herein by reference. This frequency radiator combines an energy storage function and an antenna radiating function into one structure to create an ultra-wideband frequency radiator capable of generating pulses with a range of frequency components from hundreds of megahertz to several gigahertz. Basically, this radiator utilizes two identical quasi-radial transmission line structures to store electric energy while it implements photoconductive switching to trigger the instantaneous discharge of the stored energy to generate the desired ultra-wideband RF radiation.

Such an energy storage device comprises a dielectric storage medium, two quasi-radially shaped, metalized electrodes mounted opposite one another on the top surface of the dielectric storage medium and a metalized electrode mounted on the bottom surface of the dielectric medium. A photoconductive switch, centrally located on the dielectric between the two quasi-radially shaped electrodes, connects the two quasi-radially shaped electrodes to the bottom electrodes through a load impedance. When the switch is activated by light radiation, the stored energy discharges through the load impedance generating a sub-nanosecond type pulse.

It has been recognized by those skilled in the art that the shape of the electrodes directly effects the radiation bandwidth of the generator because it directly affects the pulsewidth of the discharge. Specifically, the shape of the electrode directly affects the charging characteristics and thus the discharging characteristics of the stored energy.

It has also been recognized that the distance (gap) between the electrodes directly affects the energy storage capability. The larger the gap between the electrodes, the more energy the device can store before surface flashover and thus device breakdown occur. If the gap between the electrodes is too wide, however, the radiation bandwidth will be adversely affected (reduced).

Consequently, those skilled in the art recognize the benefits of Rf generators utilizing new and innovative electrodes having gaps that allow for high power energy storage while not degrading the radiation bandwidth.

SUMMARY OF THE INVENTION

Accordingly, the general purpose of this invention is to provide an ultra-wideband high power photon triggered frequency independent radiator providing an even greater bandwidth than previously disclosed. This object is achieved by utilizing an equiangular spiral antenna electrode (in place of the quasi-radial transmission lines disclosed above) positioned on the surface of a photoconductive semiconductor substrate such that it can store high power electrical energy and instantaneously discharge it upon photon triggering.

In a preferred embodiment, the device is comprised of a dielectric storage medium, an equiangular spiral antenna composed of two metalized electrodes (spiral arms) mounted opposite one another on a top surface of the dielectric storage medium and a metalized electrode mounted on a bottom surface of the dielectric medium (essentially forming parallel capacitors). A photoconductive element is located in the central region or photoswitching region of the photoconductive substrate between the spiral arms and between the top and bottom electrodes.

The separated spiral electrodes mounted on the top surface are positioned such that they radiate RF energy upon discharge. Moreover, the electrodes are positioned such that they can store an extremely high opposing polarity field across their arms to allow for basic isolation during the charging cycle, and thus radiate a much wider bandwidth without compromising field strength.

The operating sequence of this device is to first charge the parallel capacitors, defined above, by the pulse bias voltage +Vo and −Vo, respectively. Then, to optically activate the photoconductive element such that the charged spiral arms discharge, thus generating a time varying electromagnetic wave having a broad spectral response into the open space, perpendicular to the surface of the electrode.

The concept of the present invention is extended in another embodiment of the invention. This embodiment also consists of an energy storage device having a photoconductive means for discharging the stored energy, except the dielectric storage medium consists of two separate substrates instead of one. As such, the equiangular spiral arms on the top surface as well as the electrode on the bottom surface are separated by predetermined gap distance that allows for high power charging without degrading radiation bandwidth. The gap can be open air or even a non-conductive material having a high dielectric constant. Obviously a gap utilizing non-conductive material can be smaller than that utilizing open air with no loss in energy storage capability and an increase in radiation bandwidth. Consequently, an even higher power electric field (differing polarity) can be supported across the spiral electrode arms while maintaining charge isolation (no surface flashover) between the arms during the charging cycle.

DETAILED DESCRIPTION OF THE INVENTION

Figure 1A:
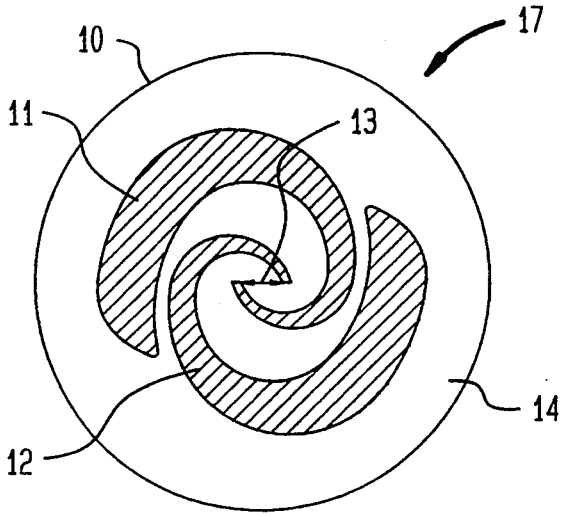
FIG. 1*a* is a top pictorial view of the dielectric medium of a preferred embodiment of the invention.

Referring now to the drawings there is shown in FIG. 1*a* a top pictorial view of the preferred embodiment 17. As shown, the top surface 14 of dielectric substrate 10 contains metalized equiangular spiral antenna arms 11 and 12. The arms are separated by gap 13 of a predetermined distance which directly affects the radiation bandwidth of embodiment 17. The narrower the gap between spiral antenna arms 11 and 12, the greater the radiation bandwidth of embodiment 17.

Figure 1B:
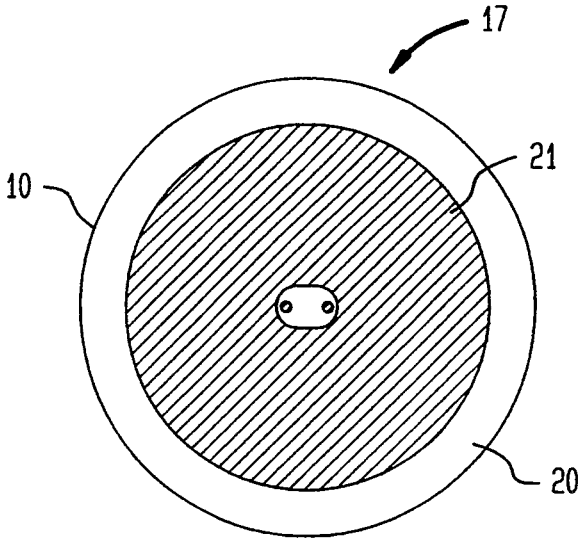
FIG. 1*b* is a bottom pictorial view of the embodiment in FIG. 1*a*.

FIG. 1*b* shows bottom surface 20 of substrate 10 substantially covered by bottom electrode 21. Spiral arms 11 and 12 and bottom electrode 21 are separated by substrate 10 and positioned (with respect to each other) such that electrical energy can be stored between them (like a capacitor).

Figure 1C:
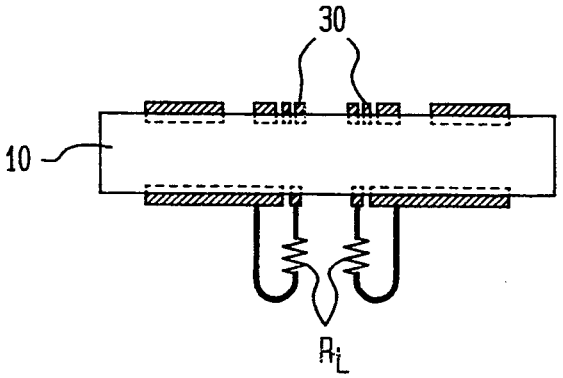
FIG. 1*c* is a side view of the embodiment in FIG. 1*a*.

In FIG. 1*c*, there is shown photoconductive element or photoswitching region or area 30 which electrically connects spiral arms 11 and 12 and bottom electrode 21 such that when light energy of a predetermined frequency is applied to photoswitching region 30, the energy stored across arms 11 and 12 instantaneously discharges through the substrate having a load (R1)—such as the air surrounding the substrate or a physical resistive element attached to the device. Such a discharge creates a time varying electromagnetic wave to propagate perpendicularly from the surface of arms 11 and 12. The radiated electromagnetic wave is comprised of a relatively high amplitude, narrow output pulse of subnanosecond pulsewidth dimension.

Figure 2A:
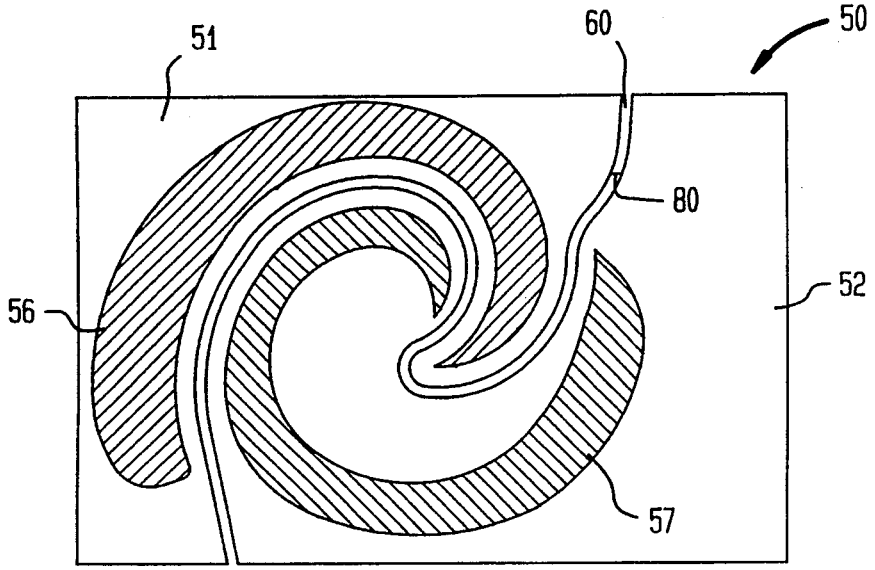
FIG. 2*a* is a top pictorial view of the dielectric medium of another embodiment comprised of two dielectric mediums.

Another embodiment is shown in FIG.'s 2*a*–*c*. FIG. 2*a* shows the top view of dielectric medium 50 comprised of dielectric substrates 51 and 52 having metalized electrodes 56 and 57, respectively on their upper surfaces. Substrates 51 and 52 are separated by a predetermined gap distance 80 comprised of non-conductive, highly dielectric material 60. Gap distance 80 directly effects the radiation bandwidth (the narrower the gap, the wider the bandwidth) and the power storage capability of the device (the wider the gap the greater the storage capability without surface flashover.

Figure 2B:
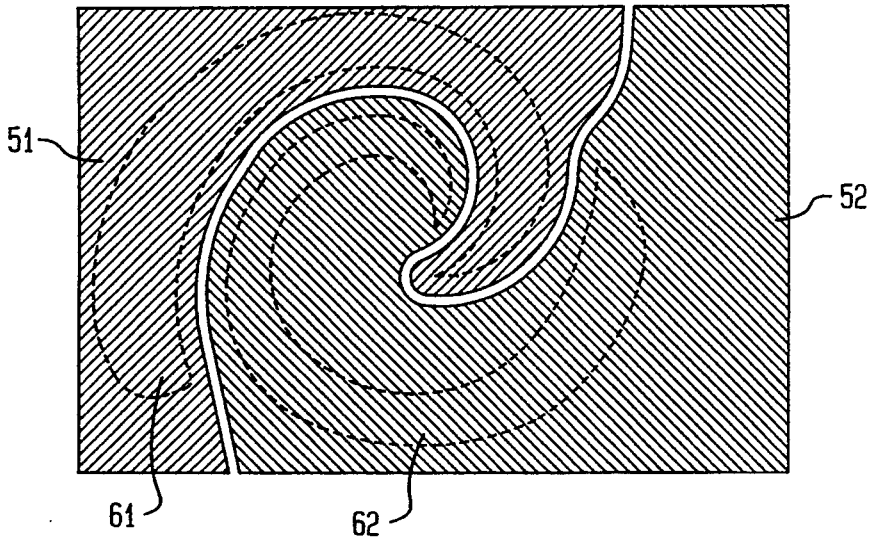
FIG. 2*b* is the bottom pictorial view of the embodiment in FIG. 2*a*.
Figure 2C:
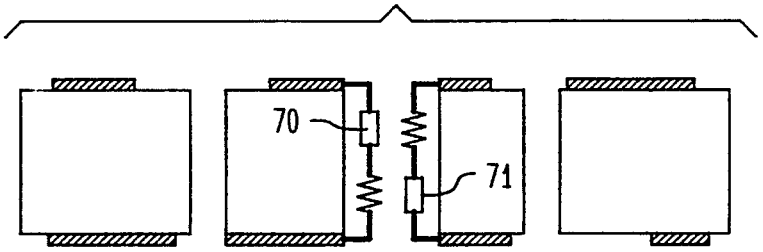
FIG. 2*c* is a side pictorial view of the embodiment in FIG. 2*a*.

FIG. 2*b* shows the bottom surface of dielectric pieces 51 and 52 each having a metalized electrode plate 61 and 62, respectively, layered thereon. Spiral arms 56 and 57 and bottom plates 61 and 62 are positioned such that they form an energy storage device capable of producing wideband radiation. As shown in FIG. 2*c*, photoconductive switches 70 and 71 electrically connect spiral arms 56 and 57 to bottom plates 61 and 62, respectively. As such, application of a predetermined light energy to switches 70 and 71. As described above, this discharge will cause a high amplitude pulse of nanosecond pulsewidth dimension to be propagated in a perpendicular direction from the surface of the spiral arms 56 and 57.

What is claimed is:

1. An ultra wideband RF radiator, comprising:

an electrical energy storage device coupled to a source of electrical voltage, said device comprised of a dielectric medium consisting of first and second dielectric pieces each having an upper and lower surface, said upper and lower surfaces of each said dielectric piece having a metalized electrode resting thereon, said upper surface electrode of each said dielectric piece forming a spiral arm, said dielectric pieces separated by a predetermined gap distance and positioned with respect to each other such their spiral arms form a spiral antenna; and a photoconductive switch electrically connected to said spiral arms, said switch becoming conductive upon the application of a predetermined type of light energy such that the energy stored by said storage device discharges through a load, said discharge generating a time varying electromagnetic wave comprising a relatively high amplitude, narrow output pulse of nanosecond pulsewidth dimension.

2. The radiator of claim 1 wherein said gap separation between said dielectric pieces is comprised of non-conductive, high dielectric material having a width equal to said predetermined gap distance.

3. The ultra wideband RF radiator of claim 1 wherein said upper metalized spiral arms are given opposite bias charge.

4. The ultra wideband RF radiator of claim 3 wherein said photoconductive switch is centrally located upon said upper surface of said dielectric substrate between said spiral arms.

5. The ultra wideband RF radiator according to claim 4 wherein said lower surface electrode is grounded.

6. The ultra wideband RF radiator of claim 5 wherein said electrical energy storage device is comprised of GaAs.

* * * * *